United States Patent [19]

Hurwitz

[11] Patent Number: 4,682,705

[45] Date of Patent: Jul. 28, 1987

[54] INTERNAL LID FOR A LIQUID CONTAINER

[76] Inventor: James D. Hurwitz, 6014 Broad Branch Rd., NW., Washington, D.C. 20015

[21] Appl. No.: 876,001

[22] Filed: Jun. 19, 1986

[51] Int. Cl.[4] ..... B65D 25/10

[52] U.S. Cl. ..... 220/93; 220/90

[58] Field of Search ..... 220/93, 334, 90; 215/DIG. 8

[56] References Cited

U.S. PATENT DOCUMENTS

| | | | |
|---|---|---|---|
| 2,726,012 | 12/1955 | Jensen | 220/93 |
| 2,828,886 | 4/1958 | Thomas | 220/93 |
| 3,266,662 | 8/1966 | Craig | 220/93 |
| 3,924,774 | 12/1975 | Donnelly | 220/93 |
| 4,312,459 | 1/1982 | Leach | 220/93 X |
| 4,416,387 | 11/1983 | D'Antonio | 220/93 |

FOREIGN PATENT DOCUMENTS

| | | | |
|---|---|---|---|
| 286233 | 2/1965 | Netherlands | 220/93 |
| 80300 | 6/1952 | Norway | 220/93 |

*Primary Examiner*—Steven M. Pollard

*Attorney, Agent, or Firm*—Fleit, Jacobson, Cohn & Price

[57] ABSTRACT

This invention is concerned with an internal lid or seal for a liquid container, preferably paint in paint cans, that reduces the tendency of the liquid to separate, dry out, form a surface scum, or deteriorate. The internal lid serves as a removable internal barrier that floats on top of the paint and prevents contact with air that is left in partially filled containers for liquids. In addition to protecting the liquid, the internal seal also provides additional security against spills and leaks. This invention may be used with non-paint containers and non-paint products.

19 Claims, 7 Drawing Figures

FIG. 1
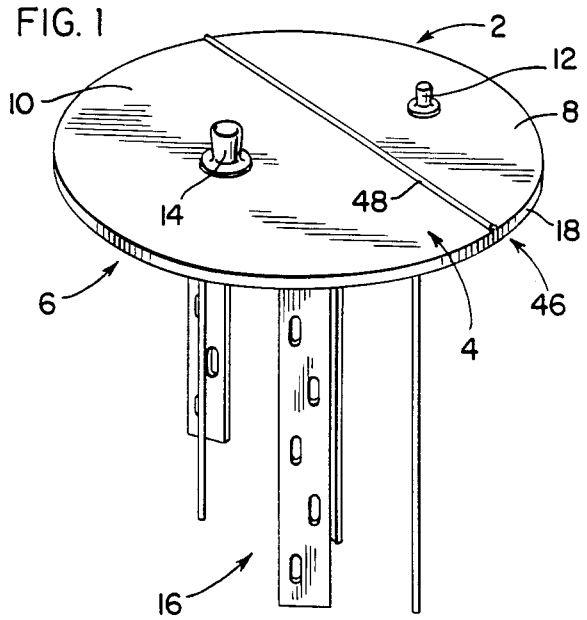
FIG. 2
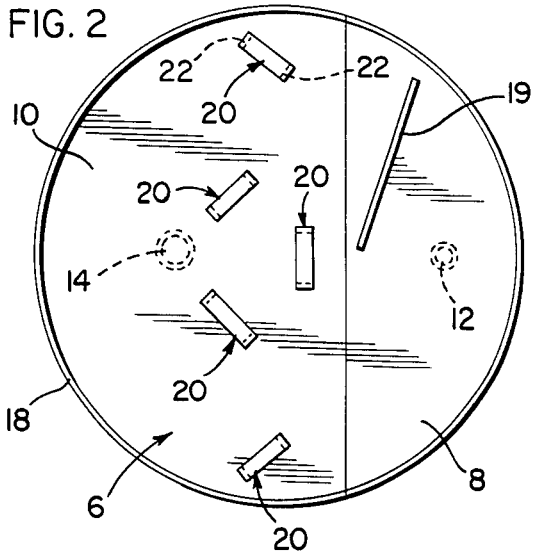
FIG. 4
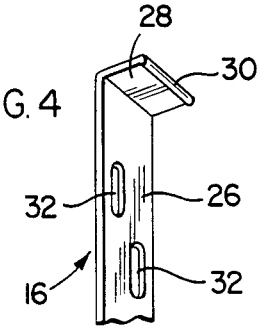
FIG. 3
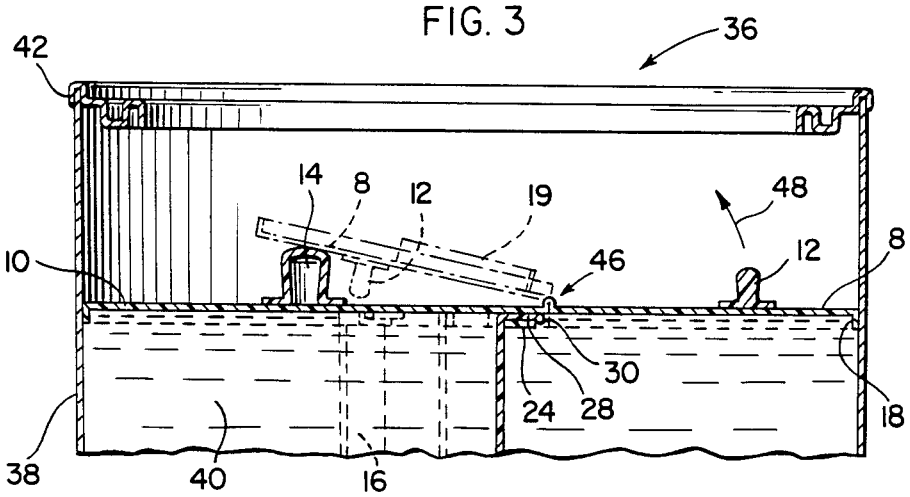
FIG. 5
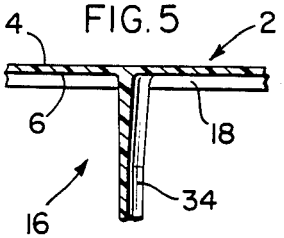
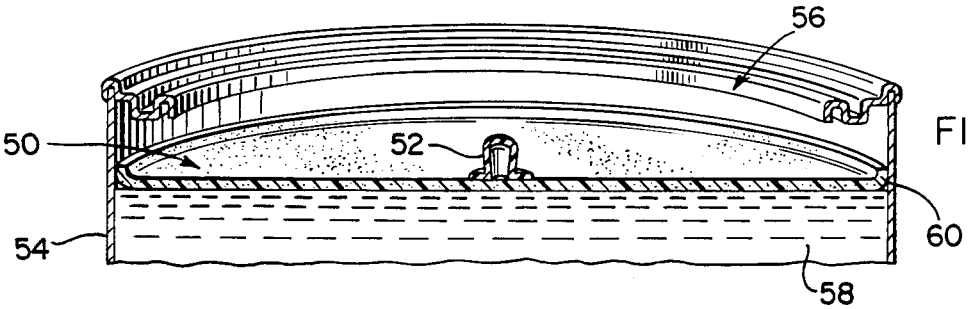
FIG. 6
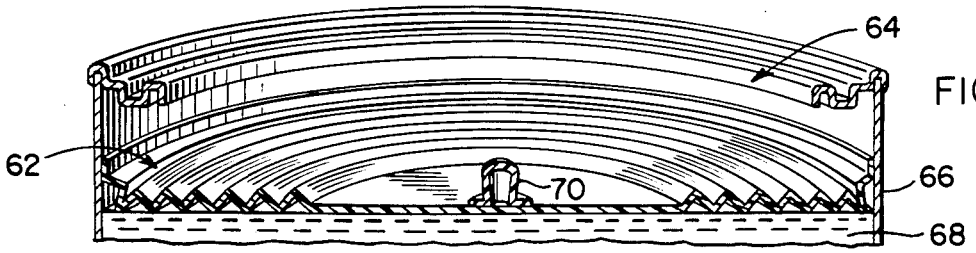
FIG. 7

INTERNAL LID FOR A LIQUID CONTAINER

BACKGROUND OF THE INVENTION

It is a common experience of professional painters and amateur decorators when opening a partially filled can of paint, for further painting or touch up work, to find the contents of the paint can have separated, dried out, formed a surface scum, or deteriorated to a point beyond possibility of further use. This is caused by contact with air which is left in the partially filled can or which leaks into cans that have not been adequately resealed, possibly due to dents in the can lid or can lip. The end result is that the partially filled can of paint is discarded.

SUMMARY OF THE PRESENT INVENTION

This invention is concerned with an internal lid or seal for a liquid container, preferably paint in paint cans, that reduces the tendency of the liquid to separate, dry out, form a surface scum, or deteriorate.

The internal lid serves as a removable internal barrier that floats on top of the paint and prevents contact with air that is left in partially filled containers for liquids. In addition to protecting the liquid, the internal seal also provides additional security against spills and leaks. This invention may be used with non-paint containers and non-paint products.

The internal lid of the present invention is placed inside a can of paint so that the paint surface is in contact with the bottom surface of the disk. The lid is made of plastic or any other suitable material which does not interact with the liquid contents of a container.

The lid may be transparent to permit viewing the can contents without removing the lid. The lid includes a surface suitable for labeling the can's contents and age, and for imprinting a logo, name or advertising message.

The lid is sufficiently flexible to permit ease of insertion into a can of a predetermined diameter. The lid includes a loop, knob or other handle to facilitate its removal.

In addition, a center or near-center "living" hinge, along a diameter or near-diameter line, permits part of the lid to be folded back upon itself, thus exposing the contents of the can. When open, the folded portion of the lid rests against a handle located on the non-folded portion of the lid to permit any of the can contents which adhere to the inside surface of the folded portion to drain back into the can.

The edges of the lid contact the inside edges of the can to fully shield the paint from contact with air or other contamination. For ease of construction, at minimum cost, the diameter of the lid should substantially equal the internal diameter of the can.

To provide a better seal, where needed, the lid diameter may be slightly larger than the can's internal diameter, for example, by making the edges of the lid or the entire lid of a foamed material, or of a design, such as accordion pleats, which permit compression of the peripheral edge of the lid against the inside walls of the can once the lid has been inserted into the can. Alternatively, the lid's edges may project in an upward or downward lip along and in contact with the can's inside surface.

An additional optional feature of the lid is to include blades which protrude from the underside of the lid so that when the lid is held by its handle, which is located on the upper surface of the lid and rotated, the protruding blades stir the contents of the can into which the lid has been inserted.

The length of the blades is sufficient to reach through substantially all of the contents of the can without causing the bottom surface of the lid be displaced above the top surface of the contents of the can. This is accomplished by cutting off the bottom of the blades. The blade length should be substantially equal to the height of the liquid contents of the can.

The blades are flexible, as is the lid, so that they bend to fit within the reduced diameter open end of a can, yet still fulfil their function of stirring the liquid contents of the can. The blades may be detachable from the bottom surface of the lid by use of a snap, button, or clasp. In an alternate embodiment, the blades are integral with the lid.

Blades of different fixed length may be provided with the lid in its commercial embodiment or distributed separately from the lid for connection to the lid. Several blades are used at once to increase effectiveness of stirring the contents of the can.

The blades may be of a flat, rectangular configuration with or without holes, be curved, or twisted in a spiral to increase effectiveness and ease of stirring. The blades are permanently affixed to the lid, detachably mounted on the bottom surface of the lid, or integral with the lid.

It is therefore an object of the present invention to prevent the separation, drying out, formation of a surface scum, or deterioration of the liquid contents of a container.

It is a further object of the present invention to protect the surface of paint in a paint can.

It is yet another object of the present invention to provide an internal lid having a diameter which is substantially equal to the internal diameter of a paint can for sealing the partially filled contents of the paint can against contact with air.

It is still yet another object of the present invention to provide mixing blades on the underside of an internal lid for mixing the partial contents of a paint can.

These and other objects of the invention, as well as many of the intended advantages thereof, will become more readily apparent when reference is made to the following description taken into conjunction with the accompanying drawings.

BRIEF DESCRIPTION OF THE DRAWINGS

FIG. 1 is a perspective view of an internal lid with blades projecting from its bottom surface.

FIG. 2 is a plan view of the bottom surface of the internal lid shown in FIG. 1 which includes hangers for mounting blades on the lid.

FIG. 3 is a sectional view of an internal lid of the present invention mounted in a container having a liquid.

FIG. 4 is a partial view of a stirring blade which is capable of being removably mounted on the bottom surface of an internal lid.

FIG. 5 is a sectional view of a stirring blade integral with an internal lid.

FIG. 6 is a sectional view of a foam material internal lid mounted in a container.

FIG. 7 is a sectional view of an accordian pleated internal lid mounted on the inside of a container.

DETAILED DESCRIPTION OF THE PREFERRED EMBODIMENTS

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

In FIG. 1, internal lid 2 is shown. Lid 2 includes a top surface 4 and a bottom surface 6. The top surface 4 is divided into two portions 8 and 10. Portion 8 includes a handle 12 and portion 10 includes a handle 14. Handles 12 and 14 may include any projection suitable for lifting of the respective portions 8 and 10.

Attached to the bottom surface 6 of portion 10 are a series of stirrer blades 16. Blades 16 are attached to portion 10 for mixing of the contents of a container into which the lid 2 is placed.

A further explanation of the blades 16 is provided with reference to FIGS. 2, 4 and 5.

Lid 2 is substantially equal in diameter to the internal diameter of a container into which the lid is placed. In FIG. 1, the lid is made of a flexible plastic sheet, in a flat form incorporating an optional downwardly projecting peripheral edge 18. The thickness of the flat sections 8 and 10 of the lid is approximately 1/16 to ⅛ inch.

In FIG. 2, the bottom surface 6 of the lid 2 is shown. Attached to the bottom surface of portion 10 are U-shaped brackets 20. Brackets 20 include two legs 22 which are attached to the bottom surface 6 of portion 10 of the lid 2. A crosspiece 24 interconnects the two legs 22 and defines an opening with the bottom surface 6 of the lid 2.

A projecting rib 19 extends from a bottom surface of section 8 at an angle to the separation line between sections 8 and 10. Rib 19 removes liquid from a brush as the brush is moved across the rib when section 8 is inclined with respect to section 10, as shown in FIG. 3. The liquid drains from section 8, by gravity, into liquid reservoir 40.

With reference to FIG. 4, blade 16 is L-shaped, having a section 26 and a section 28 extending perpendicular to section 26. At a terminal portion of section 28 is a bulbous flange 30. The thickness of the bulbous flange 30, above and below the top and bottom surface of section 28, is of sufficient thickness and the blade 16 is sufficiently pliable, to slip through the opening defined between crosspiece 20, legs 22 and bottom surface 6 of lid 2 such that the bulbous flange 30 is forced through the opening. Upon passage through the opening, the bulbous flange 30 re-expands to hold the blade 16 in place firmly anchored within the bracket 20.

Stirrer 16, shown in FIG. 4, includes holes 32. Holes 32 are provided for passage of the liquid during rotation of the lid by moving one of the handles 12 or 14.

In another embodiment of blade 16, a curved stirrer blade 34 is shown in FIG. 5. Curved blade 34 is integrally formed with lid 2 and projects downwardly from the bottom surface 6 of the lid 2.

The stirrer blade shown in FIG. 4 may be attached to the bottom surface of section 10 of the lid by various devices including snaps, glue, brackets or other means for securing a projection to the bottom of a section.

To use the lid 2 of the present invention, the lid is forced to pass through a reduced diameter opening 36 of a container 38 which includes a liquid 40. Due to the flexibility of the lid, it is easily reduced in size to fit through opening 36 and upon release, resumes its original shape. Preferably the container 38 is a paint can and the liquid 40 is paint.

After the lid 2 is slightly compressed to pass through the reduced diameter opening 36 and then allowed to re-expand to its full diameter, which is substantially equal to the internal diameter of the container 38, the lid is then placed on top of the upper surface of the liquid 40 to seal the liquid 40 from coming into contact with air. The container 38 is then resealed with its normal covering which seals the opening 36 located at the top 42 of the container 38. Also shown in FIG. 3 is a stirrer blade mounted within the opening between the crosspiece 24 of the bracket 20 and the bottom surface 6 of the lid 2.

The lid 2 seals the liquid 40 from contact with air and prevents a deterioration of the liquid or formation of a scum layer on the surface of the liquid 40.

When the liquid 40 is required to be re-used for additional painting or touch up work, in the case of paint, the portion 8 of the lid 2 is folded back onto portion 10 to expose a portion of the liquid 40. Portion 8 is folded back onto portion 10 along a "living" hinge 46 formed in the lid 2 to divide the lid into two sections 8 and 10. The hinge 46 is formed by a strip of material 48 which joins together separate sections 8 and 10.

When the section 8 is lifted by its handle 12 in the direction of arrow 48, the section 8 comes to rest against the top of the handle 14 which is mounted on the section 10. Any liquid then adhering to the bottom of the portion 8 runs down the inclined slope formed by the bottom surface of the section 8 in its retracted position. Access is then permitted to the liquid 40 through the opening formed in the lid by the folding back of section 8.

In an alternate embodiment, a lid 50 is shown in FIG. 6 having a handle 52. The lid 50 is formed of a foamed material having a diameter slightly greater than the internal diameter of container 54. When the lid 50 is compressed to fit within reduced diameter opening 56 and forced into contact with liquid 58, the lid 50 re-expands to its original configuration and the side edges 60 of the lid 50 are forced upwardly along the sides of the container 54. The lid 50 is approximately ⅛ to ⅜ inch in thickness.

The friction fit formed by the side 60 of the lid 50 and the sides of the container 54 defines a seal for preventing air from contacting the liquid 58. To gain access to the liquid 58, the lid 50 is removed by pulling upwardly on handle 52.

In FIG. 7, lid 62 is shown which is of an accordion pleated configuration. The pleats of the lid 62 are of sufficient flexibility so that when they are compressed towards each other the lid 62 fits within the reduced diameter opening 64 of container 66. Once the lid 62 is within the container 66 it re-expands to the maximum allowed diameter and forms a friction fit with the side walls of the container 66 so as to protect the liquid 68 which is located in the container 66.

The lid 62 prevents the air from contacting the liquid 68 in the container 66 and thereby prevents deterioration of the liquid 68. To gain access to the liquid 68, the lid 62 is removed by pulling upwardly on handle 70.

It is contemplated in addition that the lids shown in FIGS. 6 and 7 may be of foamed material construction and accordian pleated construction, respectively, only at an edge portion of the lid. The majority of the lid would be of a flat disk construction.

Stirring blade 16 and particularly the blades shown in FIGS. 4 and 5 provide for mixing of the contents of the container after insertion of the lid. In the case of removable blades, as shown in FIG. 4, a standard length of blade is available which may be cut to size so that the lid rests on the top of the liquid within the container.

In addition, it is contemplated to be within the scope of the present invention to have different sized blades which may be attached to the lid depending upon the depth of the liquid in the container. Blades may be secured to the bottom surface of the lid shown in FIGS. 6 and 7 in the same manner disclosed for the lid shown in FIGS. 1 through 5. Further, the blades may assume any configuration and stiffness which will attain the mixing of a liquid, such as paint, upon rotation of the lid to which they are attached.

Having described the invention, many modifications thereto will become apparent to those skilled in the art to which it pertains without deviation from the spirit of the invention as defined by the scope of the appended claims.

I claim:

1. A lid for protecting the liquid contents of a container, said lid comprising:

a body being sufficiently flexible so that when said body is inserted into a container through an opening located at the top of the container which is smaller than the dimensions of the remainder of the container, said body will be deformed to pass through said opening and resume its original configuration within the container to rest on top of liquid contents of the container forming a seal with the internal sides of the container to protect the liquid contents of the container from contact with air above said body, and said body including two portions joined together by hinge means for folding of one portion relative to the other portion so that said one portion rests above said other portion while said other portion rests on top of the liquid contents of the container, handle means mounted on a top surface of said one portion of said body for removing said body from said container and for lifting said one portion to fold said one portion over said other portion, said one portion including a projecting rib extending from a bottom surface of said one portion for removing a liquid from a brush as the brush is moved across said projecting rib when said one portion is folded over said other portion to gain access to the liquid contents.

2. The lid as claimed in claim 1, wherein said handle means includes a handle mounted on each of said two portions of said lid.

3. The lid as claimed in claim 1, wherein said body is a foamed material.

4. The lid as claimed in claim 1, wherein said body is formed of an accordian pleated material.

5. The lid as claimed in claim 1, wherein blade means project from a bottom surface of said body for mixing of the liquid contents of the container when said body is resting on top of the liquid contents of the container and when said body is rotated.

6. The lid as claimed in claim 5, wherein said blade means is integral with said body.

7. The lid as claimed in claim 5, wherein said blade means is removably mounted on said body.

8. The lid as claimed in claim 5, wherein said blades include a plurality of holes.

9. The lid as claimed in claim 5, wherein said blades are curved.

10. The lid as claimed in claim 5, wherein said blades are flat.

11. The lid as claimed in claim 1, wherein blade means project from a bottom surface of said body for mixing of the liquid contents of the container when said body is resting on top of the liquid contents of the container.

12. The lid as claimed in claim 11, wherein said blade means is integral with said body.

13. The lid as claimed in claim 11, wherein said blade means is removably mounted on said body.

14. A lid for protecting the liquid contents of a container, said lid comprising:

a body being sufficiently flexible so that when said body is inserted into a container through an opening located at the top of the container which is smaller than the dimensions of the remainder of the container, said body will be deformed to pass through said opening and resume its original configuration within the container to rest on top of liquid contents of the container forming a seal with the internal sides of the container to protect the liquid contents of the container from contact with air above said body, and said body including two portions joined together by hinge means extending across said body for folding of one portion relative to the other portion so that said one portion rests above said other portion while said other portion rests on top of the liquid contents of the container, handle means mounted on a top surface of said one portion of said body for removing said body from said container and for lifting said one portion to fold said one portion over said other portion, projecting means extending from a bottom surface of said body for mixing of the liquid upon which said body rests by the grasping of said handle means and twisting.

15. A lid for protecting the liquid contents as claimed in claim 14, wherein said projecting means is a stirring blade.

16. A lid for protecting the liquid contents as claimed in claim 14, wherein said projecting means is a paint scraping rib located on said one body portion.

17. A lid for protecting the liquid contents as claimed in claim 14, wherein said body includes an edge flange projecting from its periphery for engaging the sidewalls of the container into which the body is placed to seal the contents of the container against exposure to air.

18. A lid for protecting the liquid contents as claimed in claim 17, wherein said edge flange projects downwardly from said body.

19. A lid for protecting the liquid contents of a container, said lid comprising:

a body being sufficiently flexible so that when said body is inserted into a container through an opening located at the top of the container which is smaller than the dimensions of the remainder of the container, said body will be deformed to pass through said opening and resume its original configuration within the container to rest on top of liquid contents of the container forming a seal with the internal sides of the container to protect the liquid contents of the container from contact with air above said body, and said body including two portions joined together by hinge means for folding of one portion relative to the other portion so that said one portion rests above said other portion while said other portion rests on top of the liquid contents of the container, handle means mounted on a top surface of said one portion of said body for removing said body from said container and for lifting said one portion to fold said one portion over said other portion, said one portion including a projecting rib extending from a bottom surface of said one portion for removing a liquid from a brush as the brush is moved across said projecting rib when said one portion is folded over said other portion to gain access to the liquid contents, and mixing means projecting from body for stirring the contents of the container upon rotation of said body.

* * * * *